United States Patent [19]

Riehl

[11] Patent Number: 5,035,609

[45] Date of Patent: Jul. 30, 1991

[54] JET BURNER CONSTRUCTION, HEATING APPARATUS UTILIZING THE JET BURNER CONSTRUCTION AND METHODS OF MAKING THE SAME

[75] Inventor: Fred Riehl, Greensburg, Pa.

[73] Assignee: Robertshaw Controls Company, Richmond, Va.

[21] Appl. No.: 456,722

[22] Filed: Dec. 26, 1989

[51] Int. Cl.[5] ..... F23D 14/58

[52] U.S. Cl. ..... 431/286; 431/354; 239/597; 239/600

[58] Field of Search ..... 431/286, 353, 354; 239/597, 598, 600; 126/116 R, 99 A

[56] References Cited

U.S. PATENT DOCUMENTS

| | | | |
|---|---|---|---|
| 1,844,187 | 2/1932 | Smith | 239/597 |
| 1,925,183 | 9/1933 | Forster | 431/353 |
| 2,682,867 | 7/1954 | Cartter | 126/91 A |
| 3,288,377 | 11/1966 | Van De Roer | 239/597 |
| 3,375,792 | 4/1968 | Seeder | 126/91 A |
| 3,506,198 | 4/1970 | Van Der Zwall | 431/354 |
| 4,179,261 | 12/1979 | Riehl | 431/286 |

FOREIGN PATENT DOCUMENTS

| | | | |
|---|---|---|---|
| 2501333 | 7/1975 | Fed. Rep. of Germany | 431/354 |
| 705873 | 3/1954 | United Kingdom | 239/597 |
| 1383987 | 2/1975 | United Kingdom | 431/354 |

*Primary Examiner*—Carroll B. Dority

*Attorney, Agent, or Firm*—Candor, Candor & Tassone

[57] ABSTRACT

A jet burner construction, a heating apparatus utilizing the jet burner construction and methods of making the same are provided, the jet burner construction comprising a burner body having a chamber therein and having an inlet leading to the chamber for directing fuel from a fuel source therein and an outlet leading from the chamber and defining an outlet opening through which the fuel is adapted to issue from the chamber to burn externally to the burner body, the outlet opening having a central opening part and a plurality of spaced apart opening portions interconnected thereto and radiating outwardly therefrom whereby flows of fuel respectively issuing out of the portions and the central part of the outlet opening merge together in a turbulent manner externally of the outlet opening.

10 Claims, 3 Drawing Sheets

JET BURNER CONSTRUCTION, HEATING APPARATUS UTILIZING THE JET BURNER CONSTRUCTION AND METHODS OF MAKING THE SAME

BACKGROUND OF THE INVENTION

1. Field of the Invention

This invention relates to a new jet burner construction and to a new heating apparatus utilizing such jet burner construction as well as to new methods of making such a jet burner construction and such a heating apparatus.

2. Prior Art Statement

It is known to provide a jet burner construction comprising a burner body means having a chamber means therein and having an inlet means leading to the chamber means for directing fuel from a fuel source therein and an outlet means leading from the chamber means and defining an outlet opening means through which the fuel is adapted to issue from the chamber means to burn externally to the burner body means. For example, see the Bryant Formula 1000 heating apparatus of the Carrier Corporation of Syracuse, N.Y.

SUMMARY OF THE INVENTION

It is one of the features of this invention to provide a new jet burner construction which has improved fuel combustion while maintaining the desired port velocity of the fuel issuing therefrom.

In particular, prior known jet burner constructions have additional internal components therein for enhancing the fuel combustion by causing turbulence in the gas an//or air stream thereof.

However, it was found according to the teachings of this invention that such relatively expensive internal turbulence enhancers can be eliminated from a jet burner construction if the outlet opening means is uniquely constructed and arranged so that the same has a central opening part and a plurality of spaced apart opening portions interconnected thereto and radiating outwardly therefrom whereby the flows of fuel respectively issuing out of the portions and the central part of the outlet opening means will merge together in a turbulent manner externally of the outlet opening means for improved fuel combustion thereof.

For example, one embodiment of this invention comprises a jet burner construction comprising a burner body means having a chamber means therein and having an inlet means leading to the chamber means for directing fuel from a fuel source therein and an outlet means leading from the chamber means and defining an outlet means through which the fuel is adapted to issue from the chamber means to burn externally to the burner body means, the outlet opening means having a central opening part and a plurality of spaced apart opening portions interconnected thereto and radiating outwardly therefrom whereby flows of fuel respectively issuing out of the portions and the central part of the outlet opening means merge together in a turbulent manner externally of the outlet opening means.

Accordingly, it is an object of this invention to provide a new jet burner construction having one or more of the novel features of this invention as set forth above or hereinafter shown or described.

Another object of this invention is to provide a new method of making such a jet burner construction, the method of this invention having one or more of the novel features of this invention as set forth above or hereinafter shown or described.

Another object of this invention is to provide a new heating apparatus utilizing such a jet burner construction, the heating apparatus of this invention having one or more of the novel features of this invention as set forth above or hereinafter shown or described.

Another object of this invention is to provide a new method of making such a heating apparatus, the method of this invention having one or more of the novel features of this invention as set forth above or hereinafter shown or described.

Other objects, uses and advantages of this invention are apparent from a reading of this description which proceeds with reference to the accompanying drawings forming a part thereof and wherein:

DESCRIPTION OF THE PREFERRED EMBODIMENT

Figure 1:
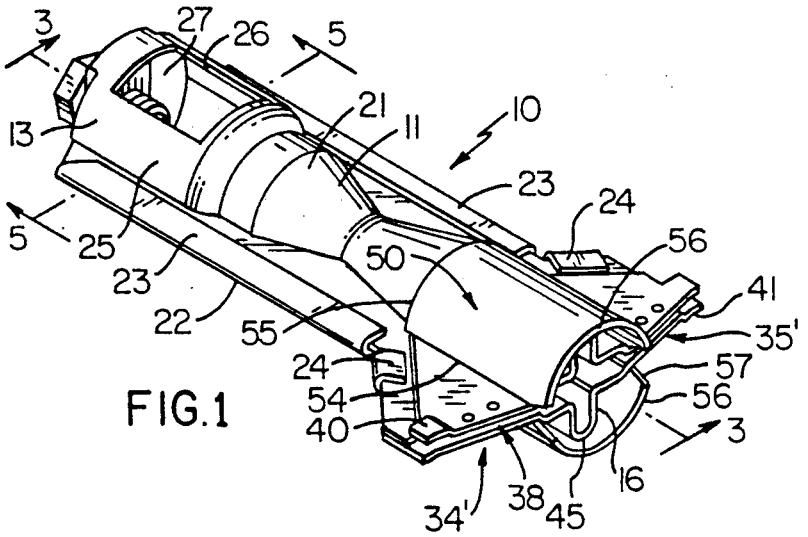
FIG. 1 is a perspective view of the new jet burner construction of this invention.

While the various features of this invention are hereinafter illustrated and described as being particularly adapted to provide a burner construction for a jet burner construction application thereof, it is to be understood that the various features of this invention can be utilized singly or in various combinations thereof to provide a burner construction for other apparatus as desired.

Therefore, this invention is not to be limited to only the embodiment illustrated in the drawings, because the drawings are merely utilized to illustrate one of the wide variety of uses of this invention.

Figure 2:
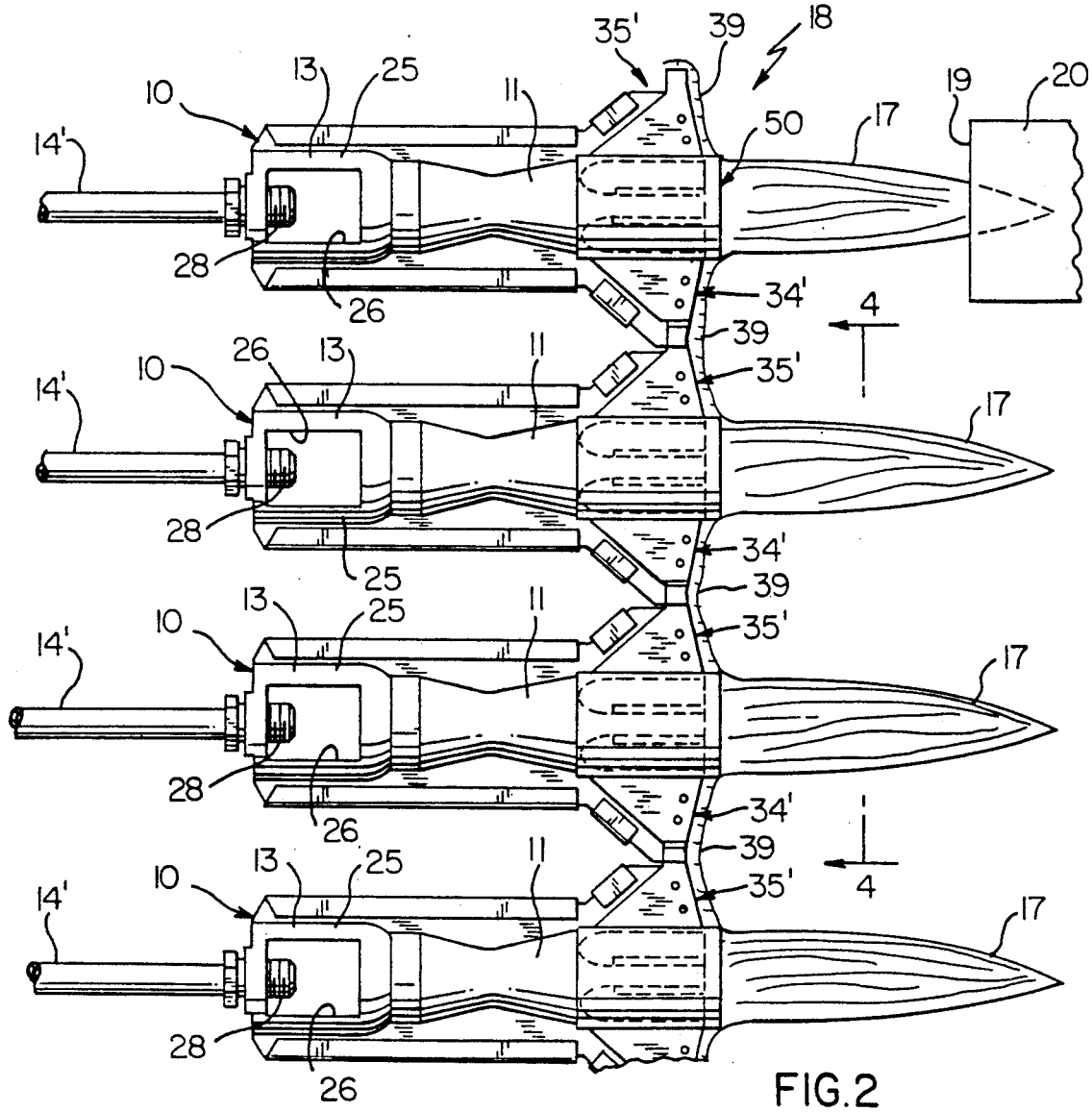
FIG. 2 is a fragmentary top view of a plurality of the jet burner constructions of FIG. 1 arranged in a heating apparatus of this invention.
Figure 3:
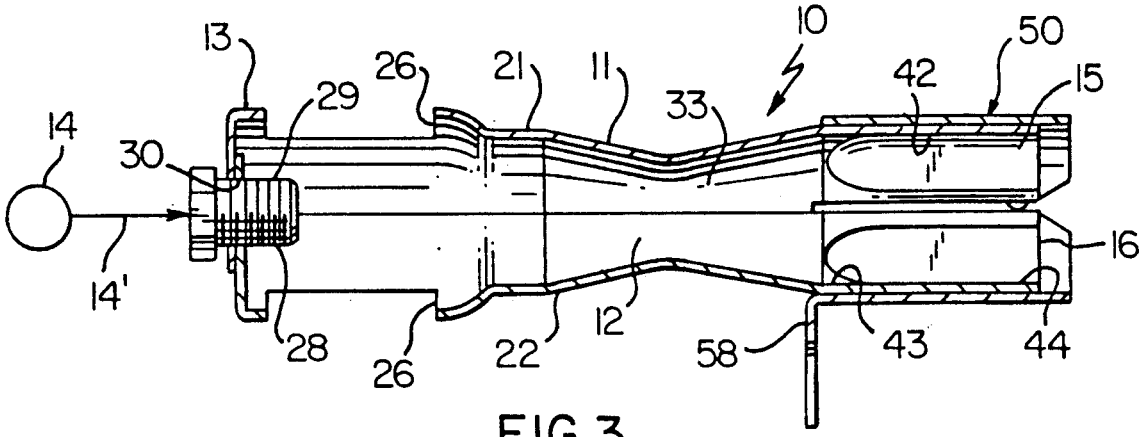
FIG. 3 is a cross-sectional view taken on line 3—3 of FIG. 1.

Referring now to FIGS. 1, 2 and 3, the new jet burner construction of this invention is generally indicated by the reference numeral 10 and comprises a burner body means 11 having a chamber means 12 therein and having an inlet means 13 leading to the chamber means 12 for directing fuel such as natural or synthetic gas, from a fuel source 14 therein and an outlet means 15 leading from the chamber means 12 and defining an outlet opening means 16 through which the fuel is adapted to issue from the chamber means 12 to burn externally to the burner body means 11 as illustrated by the flames 17 in FIG. 2.

Figure 4:
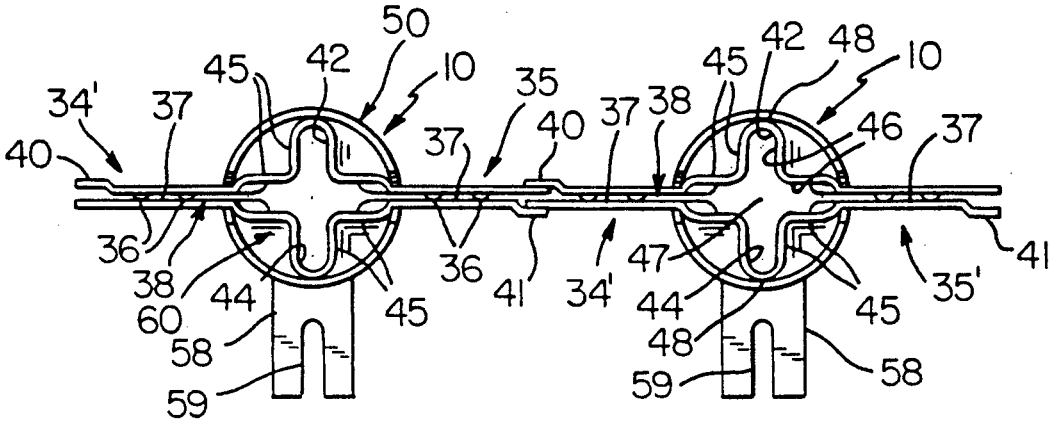
FIG. 4 is a fragmentary end view taken in the direction of the arrows 4—4 of FIG. 2 and illustrates the outlet ends of two of the jet burner constructions of this invention without having the fuel burning at the outlet ends thereof as illustrated in FIG. 2.
Figure 5:
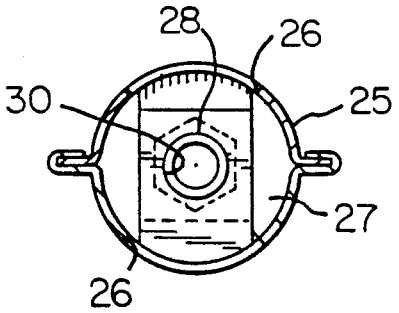
FIG. 5 is a cross-sectional view taken on line 5—5 of FIG. 1.

The jet burner construction 10 of this invention is adapted to be arranged in side-by-side aligned relation with a plurality of other jet burner constructions 10 of this invention in the manner illustrated in FIGS. 2 and 4 to be utilized in a heating apparatus that is generally indicated by the reference numeral 18 in FIG. 2 wherein each jet burner construction 10 is adapted to direct its flame 17 into an inlet end 19 of a heat tube arrangement 20 which extracts heat from that flame 17 in an efficient manner that is well known in the art. For example, see the aforementioned Bryant Formula 1000 heating apparatus of the Carrier Corporation of Syracuse, N.Y. Therefore, further details of the structure and of the operation of the heating apparatus 18 need not be set forth.

Figure 6:
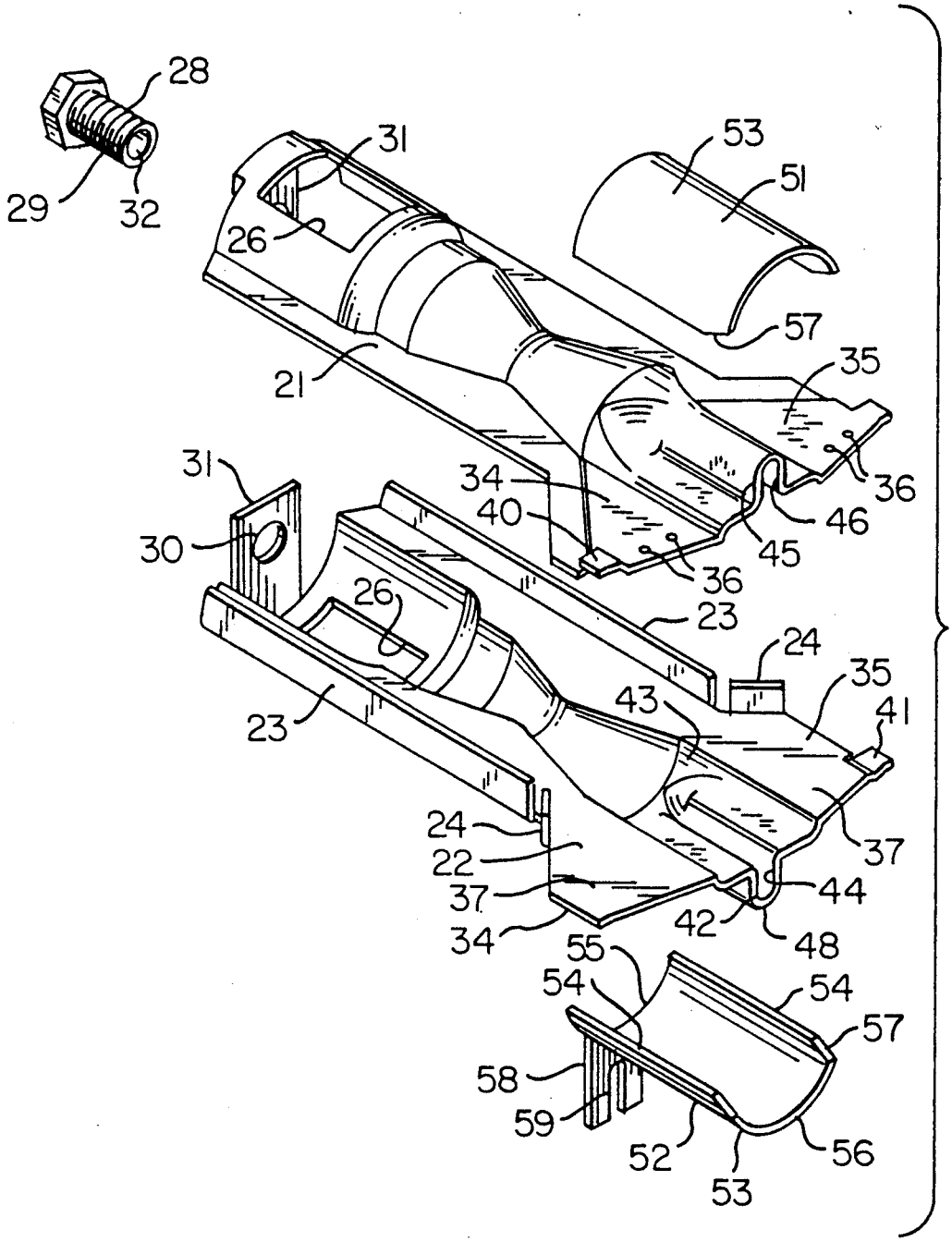
FIG. 6 is an exploded perspective view of the various parts for forming the jet burner construction of FIG. 1.

The jet burner construction 10 of this invention has the body means 11 thereof formed from two substantially similar sheet metal plates 21 and 22, FIG. 6, suitably stamped and shaped in the configurations illustrated in the drawings so that when the plates 21 and 22 are disposed together in face-to-face relation, flange means 23 and 24 of the plate means 22 are folded over against the plate means 21 in the manner illustrated in FIG. 1 to seal the plates 23 and 24 together whereby the two plate means 21 and 22 readily form the body means 11 of the burner construction 10.

In one working embodiment of the jet burner construction 10 of this invention, the plate means 21 and 22 are each formed from an aluminized steel strip RMS-421 that is approximately 0.035 of an inch thick, the resulting burner body means 11 being approximately 5.000 inches in length.

The inlet means 13 of the burner body means 11 defines a substantially cylindrical wall means 25 that has a plurality of primary air intake openings 26 formed therethrough downstream from a substantially circular end opening 27 in which an orifice member 28 is disposed, the orifice member 28 having a threaded portion 29 threadedly disposed in openings 30 formed through integral tab means 31 of the plates 21 and 22 which are bent at right angles so as to have the openings 30 thereof disposed in overlapping aligned relation as illustrated in the drawings. In this manner, fuel from the fuel source 14 is adapted to be directed to the orifice member 28 by conduit 14', FIG. 2, to issue out of an orifice 32 thereof into the chamber means 12 to mix with the primary air being drawn into the chamber means 12 through the primary air slots 26 in a manner well known in the art so that the air fuel mixture will pass through a venturi portion 33 of the chamber means 12 before the same reaches the outlet means 15 of the chamber means 12 to issue out of the outlet opening 16 in a unique manner that will be hereinafter set forth.

The plates 21 and 22 that form the burner body means 11 each has a pair of wing-like extensions 34 and 35 extending outwardly therefrom in a coplanar manner so that when the formed plates 21 and 22 are secured together by the folded over flange means 23 and 24 to form the burner body means 11, the cooperating extensions 34 and 35 define wing-like extensions that are generally indicated by the reference numerals 34' and 35', and that extend from opposed sides of the burner body means 11 adjacent the outlet end means 15 thereof.

The wing-like extensions 34 and 35 of the plate 21 are respectively stepped upwardly as illustrated and have a plurality of dimples 36 formed therein to respectively engage against the surfaces 37 of the wing-like extensions 34 and 35 of the other plate 22 so as to space the facing surfaces 37 of the cooperating pairs of wing-like structures 34 and 35 from each other to define a fuel issuing slot means 38 therebetween that respectively interconnects to the chamber means 12 and the outlet opening 16 so that fuel can issue from the slot means 38 of the wing-like extensions 34' and 35' to define front end carry-over ignition flame means 39 as illustrated in FIG. 2 for multiple burner ignition propagation purposes in the apparatus 18 in a manner well known in the art so that only ignition structure need be provided for one of the jet burner constructions 10 in the apparatus 18 and the other burner constructions 10 will be ignited therefrom in a series manner as is well known in the art.

However, in order to prevent delayed ignition due to poor alignment of the burner constructions 10, the wing-like extension 34 of the plate 21 and the wing-like extension 35 of the plate 22 of each burner body means 11 is provided with tabs 40 and 41 which are disposed or stepped out of the plane of the respective wing-like extension 34 and 35 so as to provide the overlapping linked arrangement with the nonstepped tabs 40' and 41' illustrated in FIGS. 2 and 4 of the adjacent burner constructions 10 when the jet burner constructions 10 are arranged in aligned relation as illustrated. Similar tab alignment means are set forth in the U.S. Pat. to Riehl, No. 4,179,261, whereby this patent is being incorporated into this disclosure by this reference thereto.

The outlet end means 15 of the burner body means 11 has its wall means 42 defining a substantially cylindrical portion 43 at one end thereof and a plurality of fluted portions 44 at the outlet end 16 thereof, each flute 44 comprising a substantially U-shaped portion 45 that has an outlet opening portion 46 defined thereby and radiating outwardly from a central part 47 of the outlet means 16 and being interconnected thereto. The radiating portions 46 in one working embodiment of the burner body 11 of this invention being four in number and being disposed substantially 90° apart from the adjacent portions 46 and having outer closed ends 48 thereof defining a circular configuration that is substantially concentric to the central part 47 of the opening means 16 that also defines a substantially circular configuration.

The two portions 46 on opposite sides of the outlet opening 15 interconnect with the slot means 38 of the wing-like extensions 34' and 35' of the resulting jet burner constructions 10 so as to supply fuel thereto from the chamber means 12.

In this manner, it was found that the flows of fuel issuing out of the outlet opening means 16 at the portions 46 and central part 47 thereof merge together in a turbulent manner externally to the outlet opening means 16 to provide for improved fuel combustion while maintaining the port velocity of the fuel being injected therefrom without requiring internal turbulent enhancers as in the prior known jet burner constructions. It was also found that the resulting flame means 17 of the burner construction 10 has a distinct outer and inner mantle of the flame characteristics which results from the improved fuel combustion.

In the one working embodiment of the jet burner construction 10 of this invention, each radiating portion 46 has the outer part 48 thereof defining a circle that is approximately 1.000 inch in diameter with the spacing between the legs of the portion 46 being approximately 0.186 of an inch, the throat of the venturi portion 33 being spaced from the inlet end opening 27 approximately 2.662 inches and the cylindrical wall means 25 at the inlet end means 13 being approximately 1.250 of an inch in diameter. The flutes 45 begin at approximately 3.682 of an inch from the inlet opening 27 and each has the closed end 48 thereof defined by a radius that is approximately 0.093 of an inch.

The jet burner construction 10 of this invention further comprises flame retainer means that is generally indicated by the reference numeral 50 and as illustrated in FIG. 6 comprises two parts 51 and 52 each having a body part 53 that is arcuate and defines opposed side edge means 54 and opposed end edge means 55 and 56. The flame retaining members 51 are so constructed and arranged that the same are respectively adapted to be disposed over the fluted portions 45 and have the ends 55 thereof correspond to or mate with the cylindrical portion 43 of the wall means 42 so as to be spot welded thereto or otherwise be secured to the burner body means 11 with the end edge means 56 thereof extending beyond the outlet opening 16 for flame retention purposes as will be hereinafter set forth, the cooperating side edge means 54 of the members 51 and 52 permit the wing-like extensions 34' and 35' to extend therebetween in the manner illustrated in FIG. 1.

The end edge means 56 of the member 51 and 52 are beveled at 57 where the same join with the side edges 54 as illustrated.

The lower member 52 has a tab 58 extending at a right angle to the end edge means 55 thereof and is provided with a U-shaped slot 59 therein for mounting the resulting burner construction 10 to suitable support structure (not shown) in the apparatus 18 in a conventional manner.

In the one working embodiment of the jet burner construction 10 that has been previously set forth, the members 51 and 52 of the flame retaining means 50 are each formed of an aluminized steel strip RMS-421 that is approximately 0.035 of an inch thick and each has the arcuate body portion 53 thereof defined by a radius of approximately 0.505 of an inch and each is approximately 1.578 of an inch long. The members 51 and 52 are so arranged on the burner body means 11 that the end edge means 56 thereof extend beyond the outlet opening 16 of the burner body means 11 approximately 0.187 of an inch.

It was found that with such a flame retention means 50, the flame retention means 50 restrict the flow of induced air along the areas 60 of the minor diameter formations of the fluted arrangement and thereby tends to prevent flame blow off that would cause unburned fuel to enter into the heat exchanger tubes 20 of the heating apparatus 18 whereby combustion results of the fuel issuing from the outlet opening 16 is greatly enhanced by the flame retention or retainer means 50.

Therefore, it can be seen that it is a relatively simple method of this invention to form the jet burner construction 10 of this invention that is adapted to operate in a manner now to be described.

As previously stated, once the jet burner construction 10 has been properly mounted in a suitable apparatus, such as the heating apparatus 18 illustrated in FIG. 2, fuel is adapted to be directed into the chamber means 12 of that burner construction 10 through suitable conduit means 14' leading from the fuel source 14 so that the same will draw primary air through the openings 26 into the chamber means 12 and pass through the venturi means 33 to issue out of the outlet end means 15 at the outlet opening means 16 thereof into the four flow paths provided by the radiating portion 46 of the opening 16 to combine with the fuel issuing out of the central part 47 of the opening 16 in a turbulent manner that can be ignited by any suitable ignition means so that the resulting flame means 17 will be directed into the inlet 19 of the heat exchanger tube 20 to have heat extracted therefrom in a manner well known in the art, the lit burner construction 10 creating the propagating side flame means 39 along the wing-like portions 34' and 35' thereof for igniting the issuing fuel from adjacent burner constructions 10 in the manner previously set forth.

As previously stated, the flame retention or retainer means 50 of this invention prevents secondary air from blowing the flame 17 off of the outlet opening 16 as the retention means 50 completely cover the spaces 60 between the flutes 45 so that air cannot be induced along the outside of the spaces 60 between the flutes 45 for the reasons previously set forth.

Therefore, it can be seen that this invention not only provides a new jet burner construction and a new method of making the same, but also this invention provides a new heating apparatus utilizing such a jet burner construction and a new method of making the same.

While the forms and methods of this invention now preferred have been illustrated and described as required by the Patent Statute, it is to be understood that other forms and method steps can be utilized and still fall within the scope of the appended claims wherein each claim sets forth what is believed to be known in each claim prior to this invention in the portion of each claim that is disposed before the terms "the improvement" and sets forth what is believed to be new in each claim according to this invention in the portion of each claim that is disposed after the terms "the improvement" whereby it is believed that each claim sets forth a novel, useful and unobvious invention within the purview of the Patent Statute.

What is claimed is:

1. In a jet burner construction comprising a burner body means having a chamber means therein and having an inlet means leading to said chamber means for directing fuel from a fuel source therein and an outlet means leading from said chamber means and defining an outlet opening means through which said fuel is adapted to issue from said chamber means to burn externally to said burner body means, said outlet opening means having a central opening part and a plurality of spaced apart opening portions interconnected thereto and radiating outwardly therefrom whereby flows of fuel respectively issuing out of said portions and said central part of said outlet opening means merge together in a turbulent manner externally of said outlet opening means, the improvement wherein said burner construction comprises flame retainer means carried by said body means and having outer edge means extending beyond said outlet opening means of said body means to restrict the flows of induced air between the flows of fuel issuing from said radiating portions of said outlet opening means.

2. A jet burner construction as set forth in claim 1 wherein said burner body means has wing-like extensions respectively disposed on opposite sides thereof for respectively interconnecting with adjacent wing-like extensions of adjacent burner constructions, said flame retaining means comprising two sections each having like side edge means facing said side edge means of the other section and being separated therefrom by said wing-like extensions.

3. A jet burner construction as set forth in claim 2 wherein each said section of said flame retaining means has two spaced apart said side edge means and an arcuate intermediate portion interconnecting said side edge means thereof together.

4. A jet burner construction as set forth in claim 2 wherein said burner body means is formed of two generally similar body sections secured together in superimposed relation and each having generally one-half of said outlet opening means and one-half of said wing-like extensions thereon.

5. A jet burner construction as set forth in claim 4 wherein said wing-like extensions each has an elongated outlet slot means interconnecting with said outlet opening means and through which fuel is adapted to issue so as to burn external to said wing-like extensions.

6. In a heating apparatus comprising a heating tube means provided with an inlet and a jet burner construction comprising a burner body means having a chamber means therein and having an inlet means leading to said chamber means for directing fuel from a fuel source therein and an outlet means leading from said chamber means and defining an outlet opening means through which said fuel is adapted to issue from said chamber means to burn externally to said burner body means and enter said heating tube means through said inlet thereof, said outlet opening means having a central opening part and a plurality of spaced apart opening portions interconnected thereto and radiating outwardly therefrom whereby flows a fuel respectively issuing out of said portions and said central part of said outlet opening means merge together in a turbulent manner externally of said outlet opening means, the improvement wherein said burner construction comprises flame retainer means carried by said body means and having outer edge means extending beyond said outlet opening means of said body means to restrict the flows of induced air between the flows of fuel issuing from said radiating portions of said outlet opening means.

7. A heating apparatus as set forth in claim 6 wherein said burner body means has wing-like extensions respectively disposed on opposite sides thereof for respectively interconnecting with adjacent wing-like extensions of adjacent burner constructions, said flame retaining means comprising two sections each having like side edge means facing said side edge means of the other section and being separated therefrom by said wing-like extensions.

8. A heating apparatus as set forth in claim 7 wherein each said section of said flame retaining means has two spaced apart said side edge means and an arcuate intermediate portion interconnecting said side edge means thereof together.

9. A heating apparatus as set forth in claim 7 wherein said burner body means is formed of two generally similar body sections secured together in superimposed relation and each having generally one-half of said outlet opening means and one-half of said wing-like extensions thereon.

10. A heating apparatus as set forth in claim 9 wherein said wing-like extensions each has an elongated outlet slot means interconnecting with said outlet opening means and through which fuel is adapted to issue so as to burn external to said wing-like extensions.

* * * * *